US009871305B2

(12) United States Patent
Eisert

(10) Patent No.: US 9,871,305 B2
(45) Date of Patent: Jan. 16, 2018

(54) MANTLE TERMINAL FOR ESTABLISHING ELECTRIC CONTACT

(71) Applicant: PHOENIX CONTACT GMBH & CO KG, Blomberg (DE)

(72) Inventor: Klaus Eisert, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/119,223

(22) PCT Filed: Jan. 28, 2015

(86) PCT No.: PCT/EP2015/051705
§ 371 (c)(1),
(2) Date: Aug. 16, 2016

(87) PCT Pub. No.: WO2015/128149
PCT Pub. Date: Sep. 3, 2015

(65) Prior Publication Data

US 2017/0054226 A1 Feb. 23, 2017

(30) Foreign Application Priority Data

Feb. 28, 2014 (DE) ..... 10 2014 102 659

(51) Int. Cl.
*H01R 13/40* (2006.01)
*H01R 13/46* (2006.01)
(Continued)

(52) U.S. Cl.
CPC ..... *H01R 4/30* (2013.01); *H01R 4/32* (2013.01); *H01R 13/44* (2013.01); *H01R 13/465* (2013.01); *H01R 4/22* (2013.01); *H01R 13/501* (2013.01)

(58) Field of Classification Search
CPC ..... H01R 13/44; H01R 4/30; H01R 13/465; H01R 4/34
(Continued)

(56) References Cited

U.S. PATENT DOCUMENTS 2,025,563 A * 12/1935 Bennett ..... H01H 31/127 439/780
3,067,403 A * 12/1962 Kulka ..... H01R 9/2475 439/491
(Continued)

FOREIGN PATENT DOCUMENTS

DE 561 436 A 10/1932
DE 689 525 A 3/1940
(Continued)

OTHER PUBLICATIONS

ISA/EP International Search Report, Int'l Application No. PCT/EP2015/051705, Mar. 31, 2015, European Patent Office, Rijswijk, NL, 19 pgs.

*Primary Examiner* — Briggitte R Hammond
(74) *Attorney, Agent, or Firm* — Holland & Hart LLP

(57) ABSTRACT

Aspects of the disclosure relate to a mantle terminal for establishing conducting contact, including a threaded stud for inserting a cable; a cap nut to be screwed onto the threaded stud; an insulating element inside which the cap nut is rotatably mounted and which includes a lateral plug portion; and a base plate on which the threaded stud is mounted and which includes a lateral receptacle for securely accommodating the lateral plug portion of the insulating element.

15 Claims, 2 Drawing Sheets

(51) Int. Cl.

| | |
|---|---|
| ***H01R 13/44*** | (2006.01) |
| ***H01R 4/30*** | (2006.01) |
| ***H01R 4/32*** | (2006.01) |
| *H01R 4/22* | (2006.01) |
| *H01R 13/50* | (2006.01) |

(58) Field of Classification Search
USPC ..... 439/778–780, 810–812, 727
See application file for complete search history.

(56) References Cited

U.S. PATENT DOCUMENTS 4,704,091 A * 11/1987 Owens ..... H01R 13/465 439/281
5,129,844 A * 7/1992 Goto ..... H01R 4/32 439/779
5,399,103 A * 3/1995 Kuboshima ..... H01M 2/206 439/855
5,741,153 A * 4/1998 Schwer ..... H01R 4/2429 439/491
5,924,890 A * 7/1999 Morin ..... H01R 13/641 439/490
6,211,759 B1 * 4/2001 Little ..... H01H 9/0264 439/810
7,044,426 B1 * 5/2006 Allmon ..... E04H 9/02 248/499
7,223,132 B2 * 5/2007 King, Jr. ..... B41J 2/1404 439/778

FOREIGN PATENT DOCUMENTS

| | | | |
|---|---|---|---|
| DE | 697 227 | A | 10/1940 |
| DE | 758 890 | A | 4/1941 |
| DE | 705 657 | A | 5/1941 |
| DE | 103 39 670 | B4 | 2/2006 |
| FR | 1 188 255 | A | 12/1957 |
| FR | 2 215 713 | A1 | 1/1973 |
| WO | WO 2010/040702 | A1 | 4/2010 |

* cited by examiner

MANTLE TERMINAL FOR ESTABLISHING ELECTRIC CONTACT

CROSS-REFERENCE TO RELATED APPLICATIONS

The present application is a 371 national phase filing of International Application No. PCT/EP2015/051705, entitled "MANTLE TERMINAL FOR ESTABLISHING ELECTRIC CONTACT", filed 28 Jan. 2015, which claims priority to German Patent Application No. 10 2014 102 659.4, entitled "Mantelklemme zum Herstellen eines leitenden Kontakts", filed 28 Feb. 2014.

BACKGROUND

The present disclosure relates to a mantle terminal for establishing a conductive contact having a U-shaped threaded stud for the insertion of a cable and a cap nut to be screwed onto the threaded stud.

Various versions of mantle terminals have been known for decades in electrical installation technology. In mantle terminals, the threaded stud is slit axially so as to create an upwardly open U-shaped fork from both lateral crown heads. Wires or cable ends can be inserted therein and clamped by a slotted cap nut. Versions having low impact on conductors utilize detachable washers or, in the case of a cap nut bolt, inner freely rotating studs, in order to also exert central pressure on the conductors. The cap nut is losable. In the case of cramped and hard-to-reach terminal compartments, this can lead to the nut becoming lost. Due to its required operability, the metallic cap nut is not touch-protected.

Printed publication DE 689 525 A describes in this context a mantle terminal for electrical conductors having a pressure piece rotatably mounted in the bottom of the mantle with interlocking of the mantle and base.

The task on which the present disclosure is based is that of increasing a mantle terminal's practical technical value.

SUMMARY

The subject matter solves this task by means of the features of the independent claims. Examples of the principles of this disclosure constitute the subject matter of the figures, the description and the dependent claims.

According to one aspect of the disclosure, the task is solved by a mantle terminal for establishing a conductive contact having a U-shaped threaded stud for the insertion of a cable and a cap nut to be screwed onto the threaded stud, and comprising an insulating body in which the cap nut is rotatably mounted which has a lateral plug section; and a base plate on which the threaded stud is mounted which has a lateral retainer for securely accommodating the lateral plug section of the insulating member. This thereby achieves the technical advantage of, for example, the cap nut not being able to inadvertently come loose from the mantle terminal and at the same time being touch-protected by the insulating body.

In one example of the mantle terminal, the lateral plug section of the insulating body can be moved into the retainer in the direction of being received. This thereby achieves the technical advantage of, for example, the insulating body being able to be moved upward and the U-shaped threaded stud being released without the plug section exiting out of the retainer.

In a further example of the mantle terminal, the lateral plug section is mounted to the insulating body by means of an integral hinge. This thereby achieves the technical advantage of, for example, the cap nut being able to be tilted away, facilitating the insertion of the cable.

In a further advantageous embodiment of the mantle terminal, the plug section of the insulating body is rotatably mounted in the retainer. This thereby achieves the technical advantage of, for example, the cap nut being able to be rotated sideways, facilitating the insertion of the cable.

In a further example of the mantle terminal, the lateral plug section of the insulating body is arranged parallel to the cap nut's axis of rotation. This thereby achieves the technical advantage of, for example, enabling cap nuts to be easily set onto the threaded studs.

In a further example of the mantle terminal, the retainer extends over an entire width of the base plate. This thereby achieves the technical advantage of, for example, a retainer of higher stability.

In a further example of the mantle terminal, the insulating body comprises an opening having a circumferential collar for rotating the cap nut with a tool. This thereby achieves the technical advantage of, for example, increasing the mantle terminal's contact safety.

In a further example of the mantle terminal, the cap nut is threadlessly supported in the insulating body. This thereby achieves the technical advantage of, for example, obtaining an adherent fit and the cap nut being able to be anchored by reciprocally mated retention action such as, for example, by means of a circumferential bead and groove.

In a further example of the mantle terminal, the mantle terminal comprises a latching means for the secured mounting of the insulating body to the base plate when the lateral plug section is inserted into the retainer. This thereby achieves the technical advantage of, for example, the cap nut being able to be securely connected in an easy way by the plug section being inserted into the retainer.

In a further example of the mantle terminal, the retainer has a cylindrical form. This thereby achieves the technical advantage of, for example, the insulating body being rotatably mounted.

In a further example of the mantle terminal, the retainer has a rectangular form in cross section. This thereby achieves the technical advantage of, for example, preventing the insulating body from twisting.

In a further example of the mantle terminal, the insulating body comprises a pressure piece for pressing on the cable in the threaded stud. This thereby achieves the technical advantage of, for example, improving the conductive contact.

In a further example of the mantle terminal, the pressure piece has a sawtooth profile for fixing the pressure piece in a pressure piece receptacle of the insulating body. This thereby achieves the technical advantage of, for example, the pressure piece being able to be fixed by being pressed into the insulating body.

In a further example of the mantle terminal, the insulating body comprises two diametrically facing pressure piece receptacles. This thereby achieves the technical advantage of, for example, the pressure piece being able to transfer forces to the insulating body from both sides.

In a further example of the mantle terminal, the insulating body has a snap-on plate for attaching a label. This thereby achieves the technical advantage of, for example, being able to easily label a conductor.

BRIEF DESCRIPTION OF THE DRAWINGS

Examples of the principles of this disclosure are depicted in the drawings and described in greater detail in the following.

DETAILED DESCRIPTION

Figure 1:
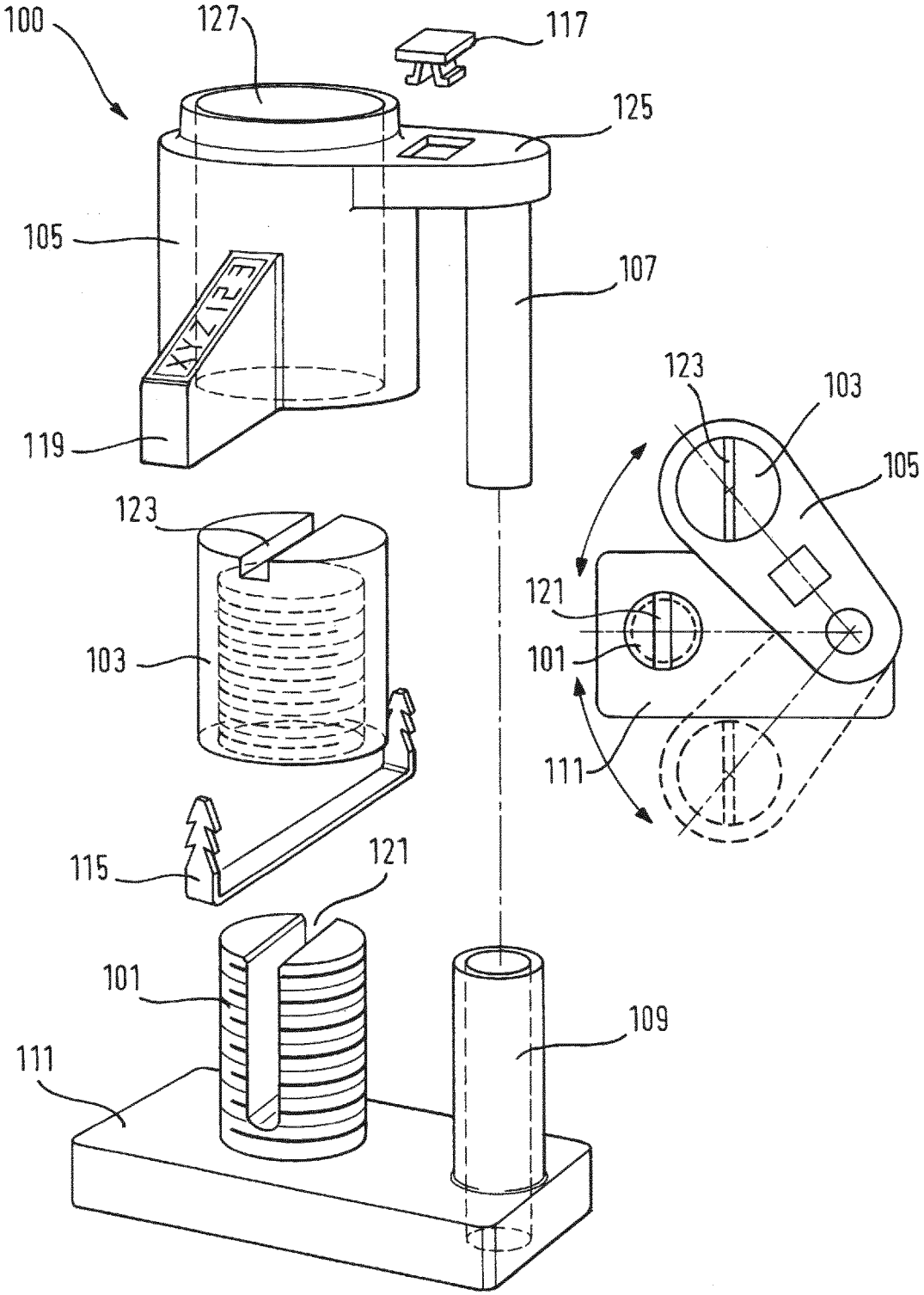
FIG. 1 shows a schematic view of an example of a mantle terminal.

FIG. 1 shows a schematic view of a mantle terminal 100. The mantle terminal 100 serves to establish a conductive contact. The mantle terminal 100 comprises a U-shaped threaded stud 101 having an external thread, a slot 121 for the insertion of a cable and a cap nut 103 having an internal thread to be screwed onto the threaded stud 101 in order to clamp the cable between the threaded stud 101 of the cap nut 103. The threaded stud 101 is mounted to a base plate 111. The base plate 111 can be formed from a molded plastic part.

The cap nut 103 is rotatably mounted threadlessly within a cylindrical recess in an insulating body 105. With an adherent fit, the cap nut 103 is moderately rotatable in common fashion within the insulating body 105, which can be formed from a thermoplastic material, and is anchored by reciprocally mated retention action, for example by means of a circumferential bead on the inner side and a groove on the outer side of the cap nut 103.

The insulating body 105 comprises a lateral plug section 107 which inserts into an retainer 109 of the base plate 111. The retainer 109 is formed by a cylindrical opening in a section of the base plate 111. The plug section 107 of the insulating member 105 and the retainer 109 of the base plate 111 run parallel to the rotational axis of the cap nut 103.

The insulating body 105 has an opening 127 which circularly exposes a slot 123 for a screwdriver for the cap nut 103 and which is provided with a circumferential insulating collar. The insulating collar on the one hand increases contact safety and, on the other, improves screwdriver guidance. In addition, a flat arm 125 with mechanisms or surfaces for affixing/applying a snap-on plate 117 for attaching a label is integrally flanged onto the upper part of the cup-shaped insulating body 105, thereby allowing the connection points to be labeled.

The plug section 107 is integrally molded to the arm 125 in the form of a parallel axial round peg. The plug section 107 is guided into the retainer 109 having a corresponding drill hole in the base plate 111. The unit of cap nut 103 and insulating body 105 is raised/ lowered in the retainer 109 by the tightening or untightening action of a screwdriver. When screwed completely upwards, the cap nut 103 can pivot sideways to the right or left about the axis in the direction of being received and, for example, under an angular limitation. The sideways pivoting of the insulating body 105 is depicted by arrows.

The plug section 107 of the insulating body 105 inserts into the retainer 109 to an appropriate depth so that it will also remain securely undetachable when screwed upwards. Fully non-detachable latching of the insulating body 105 at a pivoted position can additionally be provided.

The insulating body 105 comprises a bracket-shaped pressure piece 115 realized in the form of a U-shaped stamped part so as to have low impact on the conductors. The pressure piece 115 is burnished on its face in order to prevent damage to the conductor wires when tightening. The pressure piece 115 is securely locked into place in the laterally protruding pressure piece receptacles 119 of the non-rotatable insulating body 105.

The diametrically arranged pressure piece receptacles 119 for the pressure piece 115 are configured with protruding flanks so as to additionally provide contact safety for stripped bare wires. The bent end sections of the pressure piece 115 are given a sawtooth profile which forms barbs so that the pressure piece 115 can be fixed by being pressed into the pressure piece receptacle 119 of the insulating body 105.

The laterally protruding pressure piece receptacles 119 can be further provided with labeling surfaces. The insulating body 105 can be color-controlled, for example in order to indicate phase or voltage. All these functionalities can be realized by the plastic part of the insulating body 105.

Figure 2:
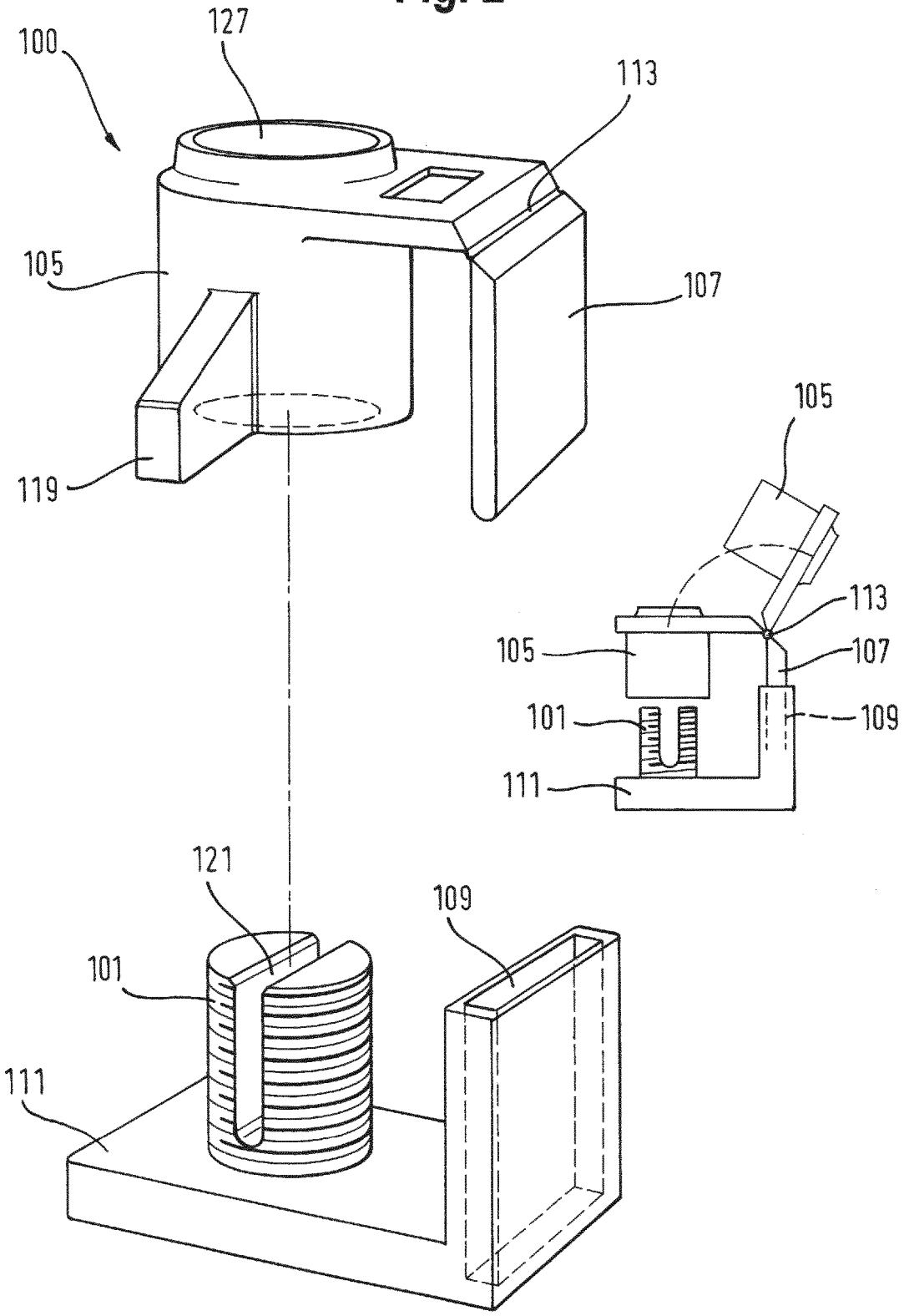
FIG. 2 shows a schematic view of a further example of a mantle terminal.

FIG. 2 shows a schematic view of a further mantle terminal 100. The mantle terminal 100 likewise comprises a U-shaped threaded stud 101 having a slot 121 for the insertion of a cable and a cap nut 103 for screwing onto the threaded stud 101 in order to clamp the cable between the threaded stud 101 of the cap nut 103 and create an electrical contact.

The retainer 109 of the base plate 111 and the plug section 107 of the insulating body 105 exhibit a rectangular form in cross section should a sideways pivoting motion not be desired for structural or technical application reasons. The plug section 107 forms a guide disk which also permits the raising and lowering of the insulating body 105 in the retainer 109. In the upwards screwed position of the cap nut 103, the cylinder portion of the insulating body 105 can be tilted away together with the cap nut 103 so as to achieve easy insertion of the conductor. An integral hinge 113 allowing said tilting is provided for this purpose in the upper part of the plug section 107.

An insulating body 105 allowing both tilting away as well as sideway pivoting of the cap nut 103 can generally also be used. In this case, a thicker round peg comprising an integral hinge in its upper section can be provided as the plug section 107 so as to be able to realize the two functional modes of tilting and sideways pivoting. Doing so thereby improves accessibility to the conductors in the U-shaped slot 121 of the threaded stud 101. In a further embodiment, two parallel guide pins can be used as plug section 107.

Except for uncut conductors, the mantle terminal 100 is also capable of directly clamping multiple conductors of differing cross sections and wire types together such as, for example, solid, stranded or fine-stranded, with or without ferrules. The mantle terminal 100 constitutes an ruggedly secure, application-specific solution for connecting conductors without impairing manipulation when said conductors are to be connected. The insulating body 105 enables the up/down movement of the cap nut 103 without it being able to become lost. The insulating body 105 enables a movable and yet secure mounting of the cap nut 103.

All of the features described and shown in connection with individual examples can be provided in different combinations in the inventive subject matter so as to realize their advantageous effects simultaneously.

The protective scope of the present invention is conferred by the claims and is not limited by the features defined in the description or illustrated in the figures.

LIST OF REFERENCE NUMERALS

100 mantle terminal
101 threaded stud
103 cap nut
105 insulating body
107 plug section
109 retainer
111 base plate
113 integral hinge
115 pressure piece

117 plate
119 pressure piece receptacle
121 slot
123 screwdriver slot
125 arm
127 opening

What is claimed is:

1. A mantle terminal for establishing a conductive contact, the mantle terminal comprising:

a U-shaped threaded stud configured for insertion of a cable and a cap nut to be screwed onto the threaded stud;

an insulating body in which the cap nut is rotatably mounted, the insulating body comprising a lateral plug section; and a base plate on which the threaded stud is mounted, the base plate comprising a lateral retainer for securely accommodating the lateral plug section of the insulating body.

2. The mantle terminal according to claim 1, wherein the lateral plug section of the insulating body is configured to be moved into the retainer in a plugging direction.

3. The mantle terminal according to claim 1, wherein the lateral plug section is mounted to the insulating body using an integral hinge.

4. The mantle terminal according to claim 1, wherein the lateral plug section of the insulating body is rotatably mounted in the retainer.

5. The mantle terminal according to claim 1, wherein the lateral plug section of the insulating body is arranged parallel to an axis of rotation of the cap nut.

6. The mantle terminal according to claim 1, wherein the retainer extends over an entire width of the base plate.

7. The mantle terminal according to claim 1, wherein the insulating body comprises an opening having a circumferential collar for rotating the cap nut with a tool.

8. The mantle terminal according to claim 1, wherein the cap nut is threadlessly supported in the insulating body.

9. The mantle terminal according to claim 1, wherein the insulating body of the mantle terminal is securely mounted to the base plate when the lateral plug section is inserted into the retainer.

10. The mantle terminal according to claim 1, wherein the retainer has a cylindrical form.

11. The mantle terminal according to claim 1, wherein the retainer has a rectangular form in cross section.

12. The mantle terminal according to claim 1, wherein the insulating body comprises a pressure piece configured to press into a slot of the U-shaped threaded stud.

13. The mantle terminal according to claim 12, wherein the pressure piece has a sawtooth profile configured to fix the pressure piece in a pressure piece receptacle of the insulating body.

14. The mantle terminal according to claim 12, wherein the insulating body comprises two diametrically facing pressure piece receptacles.

15. The mantle terminal according to claim 1, wherein the insulating body has a snap-on plate for attaching a label.

* * * * *